US005309202A

United States Patent [19]

Haneda et al.

[11] Patent Number: 5,309,202

[45] Date of Patent: May 3, 1994

[54] IMAGE FORMING APPARATUS

[75] Inventors: Satoshi Haneda; Hisao Satoh; Tadayoshi Ikeda; Shizuo Morita; Masakazu Fukuchi, all of Hachioji, Japan

[73] Assignee: Konica Corporation, Tokyo, Japan

[21] Appl. No.: 734,526

[22] Filed: Jul. 23, 1991

[30] Foreign Application Priority Data

Jul. 26, 1990 [JP] Japan ..... 2-200801
Jul. 26, 1990 [JP] Japan ..... 2-200802

[51] Int. Cl.[5] ..... G03G 5/00
[52] U.S. Cl. ..... 355/211; 355/71
[58] Field of Search ..... 355/71, 200, 211, 228, 355/260, 210; 346/160

[56] References Cited

U.S. PATENT DOCUMENTS

| | | | |
|---|---|---|---|
| 4,462,677 | 7/1984 | Onoda | 355/210 |
| 4,588,280 | 5/1986 | Ogawa et al. | 355/200 |
| 4,737,817 | 4/1988 | Kando et al. | 355/220 |
| 4,750,015 | 6/1988 | Ogura et al. | 355/203 |
| 5,047,803 | 9/1991 | Kanoto | 355/211 |

FOREIGN PATENT DOCUMENTS 247602 12/1987 European Pat. Off. .... G03G 15/00

OTHER PUBLICATIONS

Patent Abstracts of Japan, vol. 9, No. 20 (P. 330) Jan. 26, 1985 JPA-59- 165,072; Sep. 18, 1984.
Patent Abstract of Japan, vol. 13, No. 517(P-962) Nov. 20, 1989 JPA-1-210965; Nov. 20, 1989.

*Primary Examiner*—Michael L. Gellner
*Assistant Examiner*—P. Stanzione
*Attorney, Agent, or Firm*—Jordan B. Bierman

[57] ABSTRACT

An image forming apparatus in which a process cartridge, including an image carrying member and an operation member with respect to image forming, facing the image carrying member, is movably provided. An opening on the process cartridge in accordance with the operation member is covered by a shielding member in the main body of the apparatus when the process cartridge is moved from the apparatus in response to an opening movement of an external cover which provides access to the interior of the apparatus.

6 Claims, 15 Drawing Sheets

IMAGE FORMING APPARATUS

BACKGROUND OF THE INVENTION

This invention concerns an image forming apparatus by which a toner image is formed on an image carrying member by an electrophotographic method and is transferred onto a transfer material to obtain an image. This invention specifically concerns an image forming apparatus such as a printer, a copier, or a facsimile which incorporates a process cartridge, in which is integrally provided an image carrying member and at least one of developing means and cleaning means.

Image forming apparatuses are becoming increasingly complex with their declining size and weight, as well as the more advanced functions of apparatuses such as printers and copiers. On the other hand, image forming apparatus equipped with a process cartridge that combines at least developing means or cleaning means with an image carrying member have been developed in order to enable unskilled operators to perform maintenance and management easily.

Image forming apparatuses such as printers and copiers which possess this process cartridge are designed to be used by operators who do not have technical knowledge, who can easily perform maintenance and management of the image forming apparatus when the image carrying member inside the process cartridge is exhausted or depleted. For this purpose, a guide member for the process cartridge is provided to the apparatus so that correct loading, in which an optimum image can be obtained, is realized by simply inserting the process cartridge along this guide member. In conventional apparatus, the direction of handling the process cartridge and the direction of handling materials were different in fact crossing at right angles, which, in turn, not only made work troublesome but created an inevitable spatial limitation for installing an image forming apparatus. Furthermore, much space was required for maintenance work.

Patent Application Laid Open No. 61-279870 was proposed to solve these problems. An image forming apparatus which is capable of simplifying handling and operation of expendables and reducing limitations of work space by matching the loading direction of materials and the loading/unloading direction of the process cartridge installed on the upper frame has been proposed.

However, the image forming apparatus disclosed in Patent Application Laid Open No. 61-279870 requires opening of the upper frame for an operator to pull out and remove the process cartridge from the upper frame when replacing the process cartridge. For this reason, not only is this work very troublesome but requires considerable force on the part of the operator if the process cartridge is heavy or bulky. Furthermore, it is necessary for an operator to put his hand into a small space to remove transfer materials when a jam occurs, and such jam procedure work is difficult as sufficient work space cannot be secured, no matter how far the upper frame is opened. Moreover, the operators hand sometimes comes into direct contact with portions stained by toner or with the image carrying member itself. Furthermore, moving or removing the process cartridge required a significant pulling motion of the process cartridge by the operator from the upper frame to secure that work space, making this work troublesome and creating a defect of difficult jam procedure.

In addition, this invention concerns technology for accomplishing an improvement of handling and maintenance work as well as compactization of an electrophotographic image forming apparatus.

It is desirable to keep the image carrying body of an electrophotographic image forming apparatus, i.e. generally a belt-shaped or drum-shaped body which is referred to as photoreceptor belt or photosensitive drum, in a light-sealed condition at all times because its photosensitivity will diminish when left in a lighted room. Unfortunately, it is necessary to open a part of the outer cover to observe the condition inside and to take proper measures in order to remove or recover jammed papers which occurs around photoreceptor in the image forming apparatus. As a photoreceptor belt or photosensitive drum is deteriorated after being exposed to bright light at that time, the apparatus is designed in such a way that a protective cover, which is provided where the photoreceptor is exposed, is opened and closed according to the opening and closing of the outer cover. However, it is difficult to shut out light completely, and the mechanism becomes complex and leakage of light still occurs. If much time is spent dealing with troubles, then the photoreceptor will actually be exposed without a cover for a long period of time.

In particular, although cartridges have been introduced to areas around the photoreceptor to further compactize the image forming apparatus and improve operability, light sealing measures are not perfect and deterioration of the photoreceptor is not completely eliminated.

SUMMARY OF THE INVENTION

An object of the present invention is to provide an image forming apparatus in which moving and exchanging of a process cartridge can be conducted by a simple operation, and in which the image forming performance of the photoreceptor is not diminished as a result of fatigue from light thereon. Another object is to provide an image forming apparatus in which safe and easy exchanging of relatively heavy process cartridges such as those for color image forming apparatus can be performed.

A further object of the present invention is to provide an image forming apparatus which is easy to handle and is well protected against light.

The structure of image forming apparatus of the present invention is achieved by either (a) or (b) below.

(a) A working member is installed in the main body of an image forming apparatus so that the working member may face an image carrier in a process cartridge which is movably provided to the apparatus, and a window of the process cartridge is provided in a position so that the window may be covered by a cover built in the main body when the process cartridge moves corresponding to the opening motion of an opening and closing member on the apparatus.

(b) The working member is a discharging means and/or a charging means and/or an exposure means.

Another structure of an image forming apparatus in this invention is achieved by (a), (b) (c) or (d) below.

(a) Protection of an image forming body attained by opening and closing of a movable protective cover provided on the main body and formation of large space around a transfer sheet conveyance area, are carried out by a loading/unloading movement of a process cartridge including the image forming body along a guide on the image forming apparatus main body and opening and closing of a movable protective cover provided on the main body.

(b) Opening and closing of the movable protective cover is performed through its rotational movement which accompanies the loading/unloading movement of the process cartridge.

(c) The movable protective cover has a working member which is a discharging means and/or a charging means and/or an exposure means.

(d) The light tightness of the image forming body is achieved by the closing movement of the movable protective cover.

DESCRIPTION OF THE PREFERRED EMBODIMENTS

Next, this invention will be explained based on an embodiment shown in the attached diagram.

Figure 1:
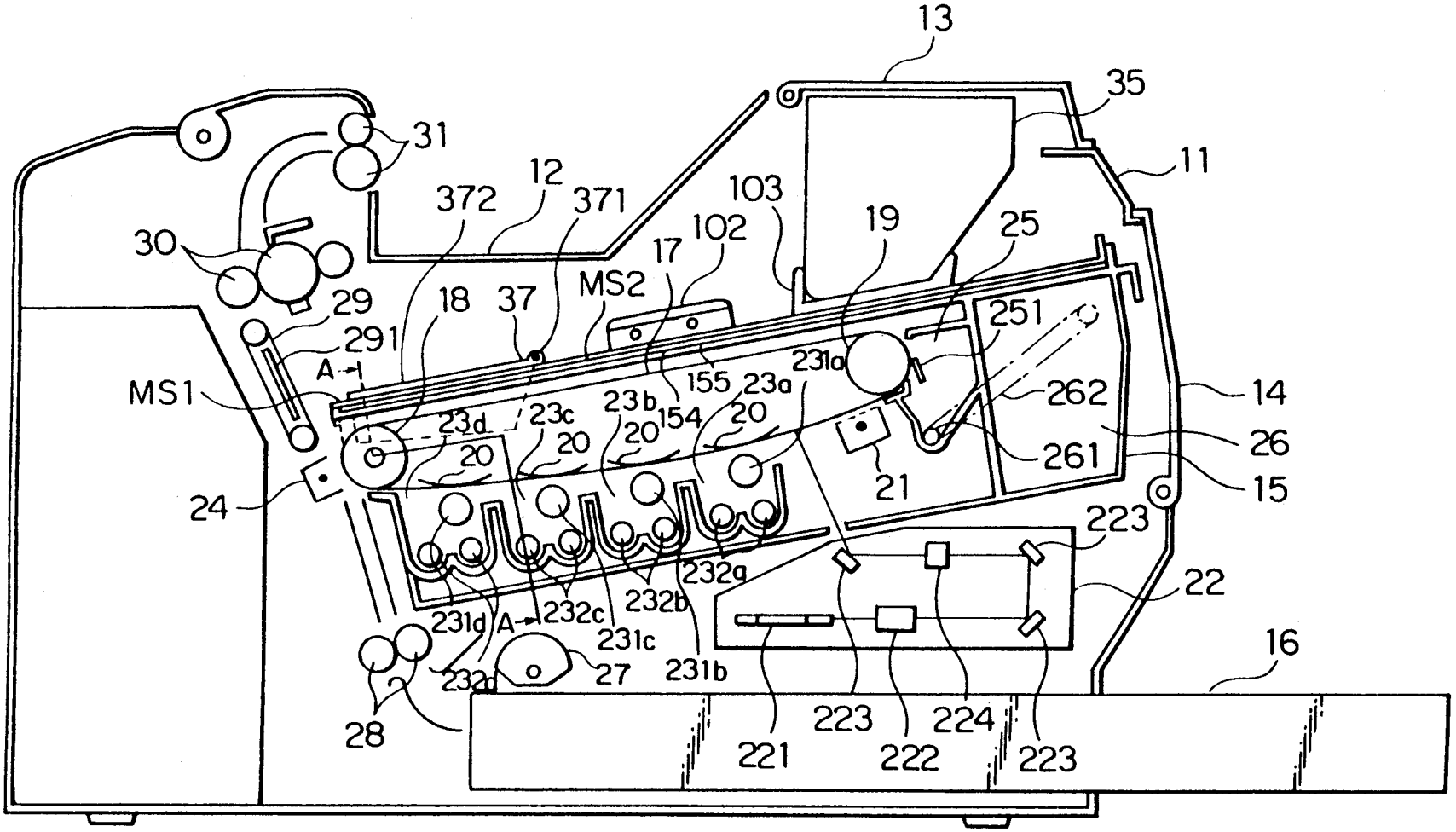
FIG. 1 is a diagram showing the main cross section of the color printer to which this invention is applied from the left side.

FIG. 1 shows the main cross section of the color printer to which this invention is applied from the left side. The apparatus body 10 is surrounded by an operation panel 11, upper cover 12 that can be opened and closed, toner supply cover 13 and front cover 14, and has process cartridge 15 that can be loaded and unloaded and paper feed cassette 16.

In FIG. 1, photoreceptor belt 17, which is an image carrier, is made by applying a photosensitive layer on the surface of a flexible belt surface and is stretched between drive roller 18 and follower roller 19. Drive roller 18 rotates through a drive gear which is engaged with a gear in the apparatus 10 (to be explained later) and transports the photoreceptor belt 17 clockwise. In addition, spacing member 20 is used to keep a constant distance between developing means 23*a–*23*d* and photoreceptor belt 17, thereby making it possible to form a stable and excellent image. Although photoreceptor belt 17 is used as an image carrier in this embodiment, this invention is not limited to this photoreceptor belt and can be applied to conventional image carriers with a photosensitive layer such as photosensitive drums.

Charging means 21, exposure means 22, developing means 23*a–*23*d*, transfer means 24 and cleaning means 25 are provided around photoreceptor belt 17.

Charging means 21 charges the photosensitive layer on the surface of photoreceptor belt 17 in a uniform manner at a prescribed polarity, and may be a conventional charger 21 such as corona charger or a scorotron charger. The use of scorotron charger is favored when used on a OPC photosensitive body.

Exposure means 22 is a semiconductor laser write system and forms a latent image by exposing the surface of photoreceptor belt 17.

Developing means 23*a–*23*d* contain toner (developers) of different colors such as yellow, magenta, cyan and black. These respective developing means 23*a–*23*d* are equipped with developing sleeves 231*a–*231*d* for keeping a certain gap with photoreceptor belt 17, and stirring screw 232*a–*232*d* for stirring toners of respective colors, and develops the latent image on photoreceptor belt 17 through the non-contact developing method. Unlike the contact developing method, this non-contact developing method does not damage the previous toner image formed on photoreceptor belt 17 nor does it disturb the movement of photoreceptor belt 17. Developing is not limited to color development using four toners of different colors as in this embodiment; one color, two colors, or three colors can also be used, in which case the same number of developing means as the number of colors need to be laid out around the photoreceptor belt 17.

Transfer means 24 transfers the toner image formed on photoreceptor belt 17 onto a transfer material using a transfer pole 24 such as a transfer corona discharger. Conventional transfer means such as a transfer drum can be used instead of transfer pole 24 as this transfer means.

Cleaning means 25, which has a cleaning blade 251 and is kept at a position apart from the surface of photoreceptor belt 17 during the image forming process, cleans the photoreceptor belt 17 by pressure on photoreceptor belt 17 only at the time of cleaning after a toner image is transferred to a transfer material.

Collection box 26 is for collecting and storing the residual toner, which has been removed by cleaning means 25, from photoreceptor belt 17 via toner collection pipe 262 using waste toner screw 261.

In this embodiment, the respective process units mentioned above, which constitute an image forming unit of the aforementioned printer, are integrated into a process cartridge 15, and can be loaded and unloaded as a whole to and from the apparatus body 10. However, the process units that can be included in the unit inside process cartridge 15 are not limited to the above. The minimum requirement is to include photoreceptor belt 17 and developing means 23*a–*23*d*, or photoreceptor belt 17 and cleaning means 25 in the unit, or other process units can be included in the unit.

The process of color image forming using a color image forming apparatus with the aforementioned structure is performed as follows.

First, process cartridge 15 is loaded at the first position and is in a status which is capable of image forming.

Then a laser beam by semiconductor laser is generated in laser writing system unit 22 (not shown in the diagram), the image signal of the first color which is output from the image reading apparatus which is separate from the apparatus body 10 is input to the laser writing system unit 22. This laser beam is rotated and scanned by a polygon mirror which is rotated by a drive motor (not shown in the diagram), and is projected on the peripheral surface of photoreceptor belt 17 which has been uniformly charged to a prescribed electrical charge by charger 21 and forms a bright line after going through a f$\theta$ lens 222, cylindrical lens 224 and three mirrors 223.

Meanwhile, concerning the direction of secondary scanning line, the primary scanning line from which the modulation of semiconductor laser by image signal is started is determined by detecting a belt index corresponding to a specific position of photoreceptor belt 17 (not shown in the diagram) or by receiving a print instruction signal and using this detection or instruction signal as the standard. Once the scanning is started, laser beam is detected by index sensor (not shown in the diagram) with regard to the direction of primary scanning, and modulation of semiconductor laser is started by using this detected signal as the standard and the modulated laser beam scans over the surface of photoreceptor belt 17. Accordingly, the latent image corresponding to the first color is formed on the surface of photoreceptor belt 17 which has been uniformly charged with electricity by the primary scanning using laser beam and secondary scanning from the transport of photoreceptor belt 17. This latent image is developed by developing means 23*a* which stores a yellow toner corresponding to the first color among the developing means, forming a yellow toner image on the surface of photoreceptor belt 17. Then the photoreceptor belt 17, while holding a yellow toner image on its surface, starts to form the second color after passing under the cleaning blade 251 which is apart from the surface of photoreceptor belt 17.

Photoreceptor belt 17, on which a yellow toner imaged has been formed, is once again electrically charged uniformly by charger 21. Then the image signal for the second color is input into the aforementioned laser writing system unit 22, and a latent image is formed as writing on the surface of photoreceptor belt 17 is performed in the same way it was performed in the case of aforementioned image signal for the first color. The latent image is developed by developing means 23*b* which stores a magenta toner as the second color. The magenta toner image is formed on the yellow toner image which is already formed.

Similarly, a cyan toner image is formed by developing means 23*c* which stores the cyan toner after a latent image by the image signal of the third color is formed. Moreover, a color toner image is formed on the surface of photoreceptor belt 17 by registrating a black toner image over the surface of photoreceptor belt 17 by developing means 23*d* which stores black toner after a latent image using the image signal of the fourth color is formed.

Direct or alternating current bias is applied on the developing sleeves 231*a*–231*d* of these developing means 23*a*–23*d* so that a non-contact development (jumping development) will be performed on the photoreceptor belt 17 whose base body is grounded. Incidentally, either one component developer or two-component developer can be used for this non-contact development. Although compactization can be achieved by using a one component developer, the developing method using two-component developer is more favorable in terms of color reproduction as it is superior in development stability.

As mentioned above, the color toner image formed on the surface of photoreceptor belt 17 is transferred to a transfer material (transfer paper) supplied from feed cassette 16 by feed roller 27, whose timing is adjusted to the aforementioned color toner image by timing roller 28. Transfer means 24 performs the transfer by applying high power output which has the opposite polarity to the toner.

The transfer material on which a color toner image has been transferred in this manner is surely separated by the photoreceptor belt 17 which rapidly changes its direction around the drive roller 18 and carried upward by transport belt 29. This transport belt 29 is equipped with a sucking means 291 which transports upward surely by sucking. Then the transfer material is discharged on the upper surface of the upper cover 12, which also serves as exiting tray, after having toner melted and fixed by a fixing roller 30.

Meanwhile, the photoreceptor belt 17 which has completed the transfer of color toner image to the transfer material is carried clockwise, passes by member 102 where a neutralizing unit, which is comprised of a discharging lamp or a discharging corona or an exposure means on the main body. After the charge on the surface of photoreceptor belt 17 is removed here, removal of remaining toner and cleaning are performed by cleaning means 25 where cleaning blade 25 is pressed thereto. After the cleaning is completed, cleaning blade 251 is separated again from the photoreceptor belt 17 and a new image forming process is started.

Next, the drive system for process cartridge 15 and the drive system for process cartridge movement will be explained by using FIG. 2 through FIG. 5 as reference.

Figure 2:
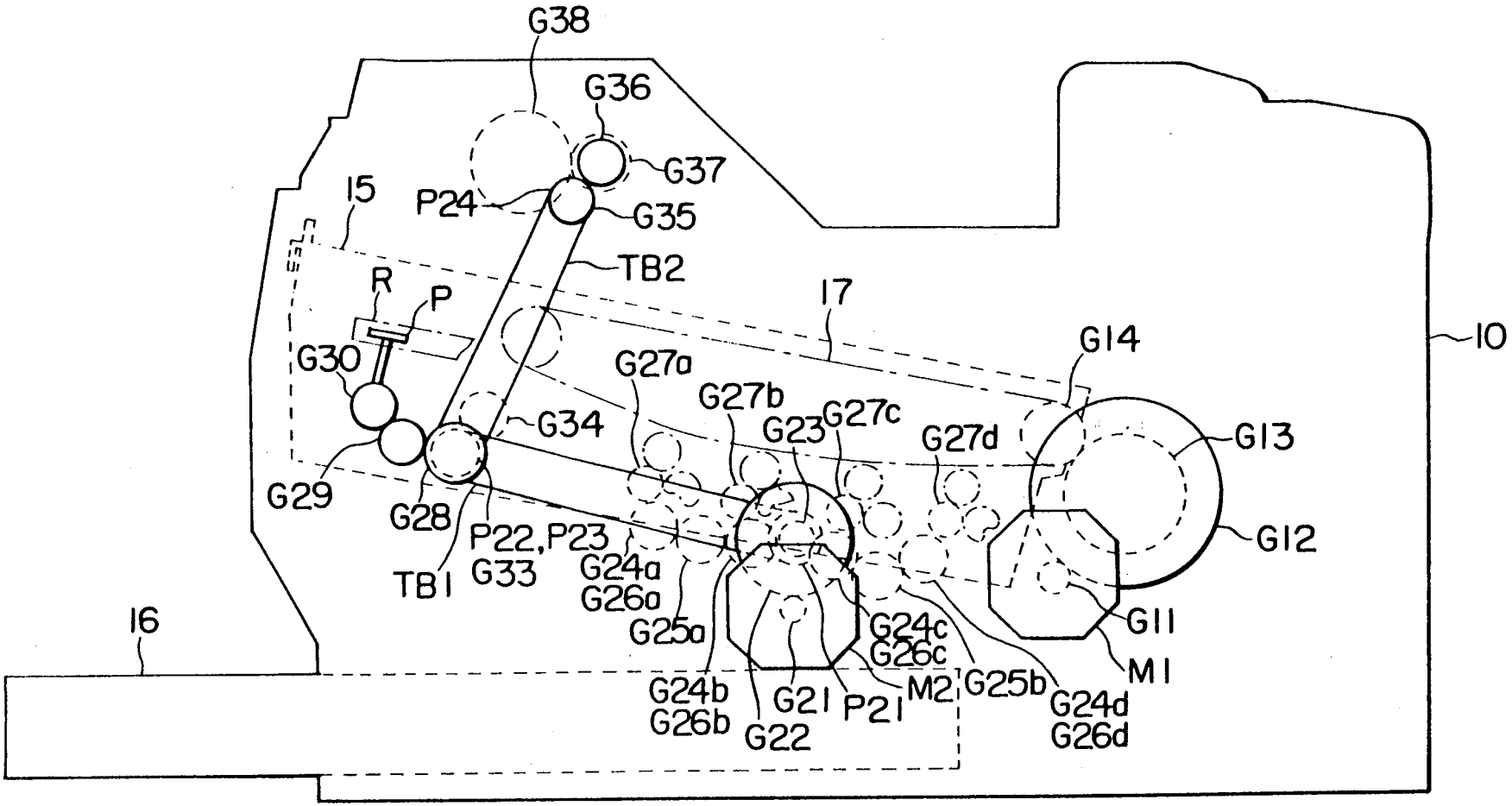
FIG. 2 is a diagram showing the drive system involving this invention from the right side.

FIG. 2 is a diagram showing the right side view of the drive system of process cartridge 15 and the drive system for process cartridge movement. Incidentally, the drive system for process cartridge 15 and the drive system for process cartridge movement are driven by using two motors M 1 and M 2.

First, the driving force from motor M 1 is used on the drive system for photoreceptor belt 17. Gear G 12 is installed in such a way that it will engage with the gear G 11 on the axis of motor M 1. Moreover, drive gear G 14, which is installed on the same axis as drive roller 18 for transporting photoreceptor belt 17, is engaged with gear G 13 which rotates together with gear G 12 when process cartridge 15 is at a position where an image can be formed. In other words, the rotation of motor M 1 is delivered to drive gear G 14 via gear G 11, gear G 12 and gear G 13 and adjusted to an adequate rotation speed. Furthermore, it rotates drive roller 18 in counterclockwise direction in one body with drive gear G 14 in the same diagram and transports photoreceptor belt 17.

Figure 3:
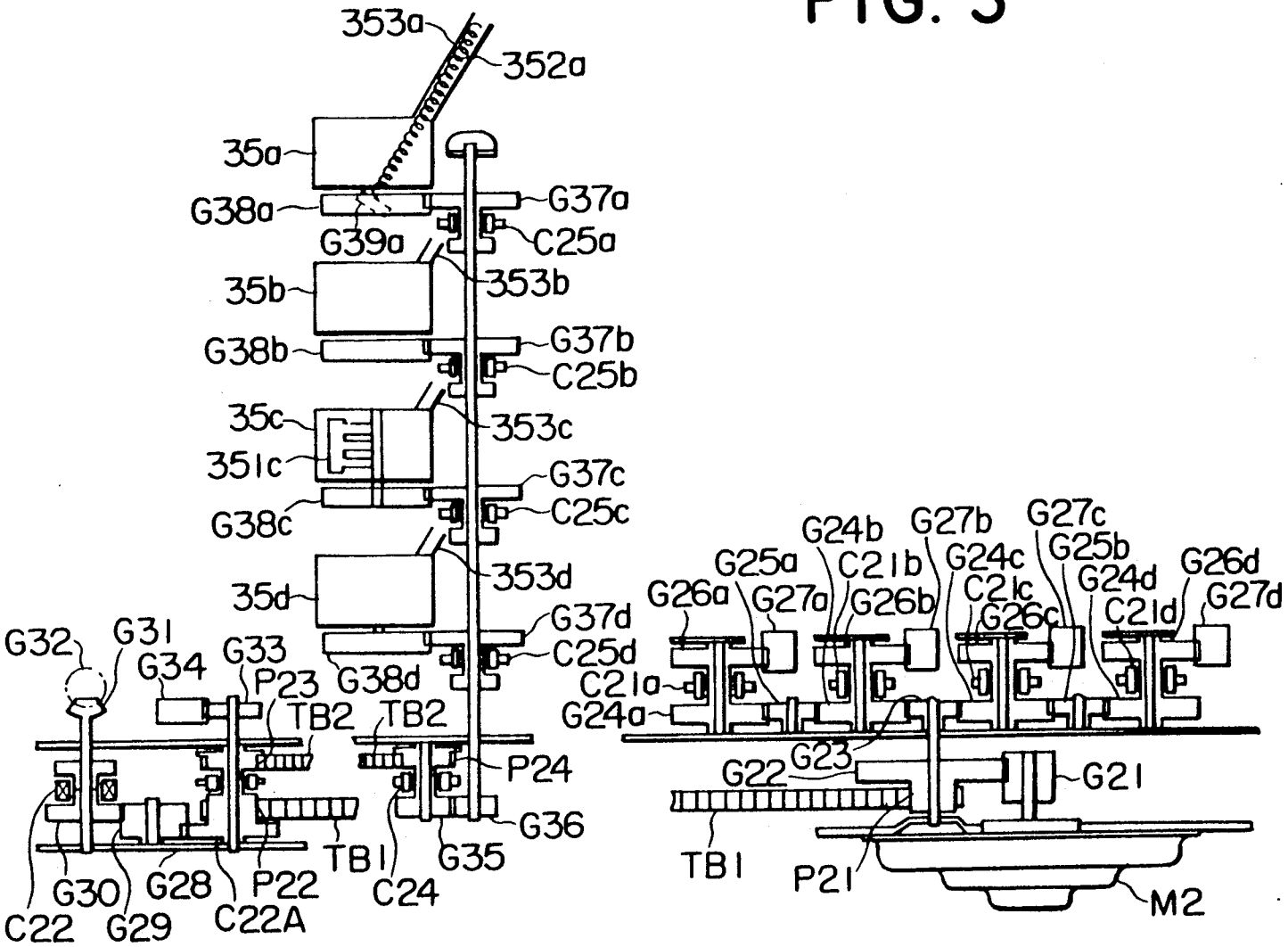
FIG. 3 is a diagram showing the drive system for process cartridge movement as seen from above.
Figure 4:
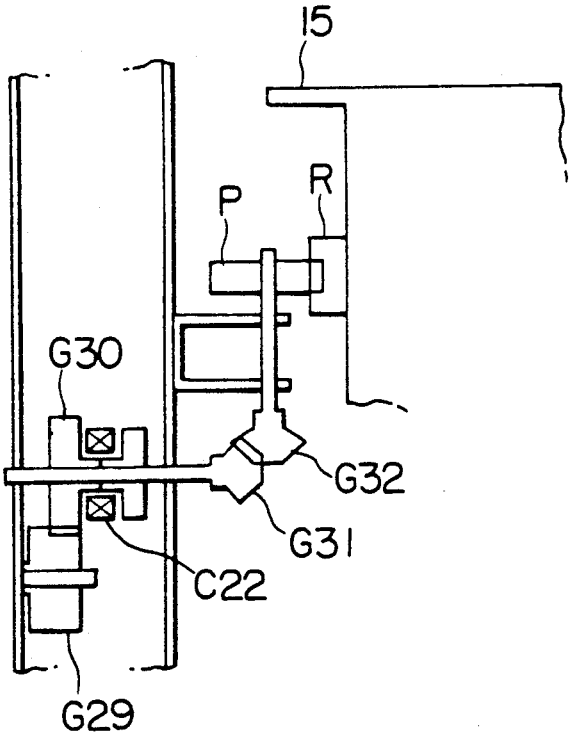
FIG. 4 is a diagram showing the principal part of the drive system for process cartridge movement.

Next, the drive system for developing means 23*a*–23*d*, waste toner screw 261, toner hopper 35 and process cartridge moving means will be explained by using FIG. 2 and FIG. 3 as reference.

Motor M 2 is used for this drive system. The rotational force of motor M 2 is delivered to gear G 22 via gear G 21 on the motor M 2 axis. It is then delivered to gear G 23 which is installed on the same axis and body as gear G 22 to drive the drive system of developing means 23*a*–23*d*.

The first explanation will be on the drive system of developing means 23*a*–23*d*.

The rotational force of motor M 2 which has been delivered to gear G 23 is delivered to gear G 24*b* and gear G 24*c*, and to gear G 24*a* and gear G 24*d* via gear G 25*a* and gear G 25*b*. Furthermore, gears G 26*a*–G 26*d* are laid out on the same axis as gears G 24*a*–G 24*d* via an open-type spring clutch to deliver only the rotation in one direction, and at positions where process cartridge 15 can form an image, in such a way that they will engage with developing means drive gears G 27*a*–G 27*d* that are installed process cartridge 15. Then the rotational force that has been delivered to developing means drive gears G 27*a*–G 27*d* is delivered to developing means sleeves 231*a*–231*d* and to churning screws 232*a*–232*d* via gears on process cartridge 15. In other words, in order to drive developing means 23*a*–23*d*, the rotation of motor M 2 is delivered to gear G 24*b* and gear G 24*c* via gear G 21, gear G 22 and gear G 23, and to gear G 24*a* and gear G 24*b* via gear G 25*a* and gear G 25*b*, and then to developing means drive gears G 27*a*–27*d* when necessary by engaging the clutch. Incidentally, it would be better if the drive on developing means 23*a*–23*d* that are in the process of forming an image drove only the developing means that correspond to respective colors in the image formation and will not drive developing means 23*a*–23*d* during the process cartridge 15 movement which will be described later. For this purpose, it is advised to give phase contrast to each cam (not shown in the diagram) which has a claw that comes in contact with the ratchet of clutches C 21*a*–C 21*d* (not shown in the diagram), and control them through a step motor (not shown in the diagram) by creating five optional positions including a position where no clutch will be connected. For instance, it is possible to control the drive developing means 23*a*–23*d* so that only one of them will be driven or none of them will be driven by creating a 72 degree phase contrast on the four cam claws that correspond to each clutch and rotating the step motor by 72 degrees steps.

The next explanation will be on the moving means of process cartridge 15.

The rotational force of motor M 2 that has been delivered to gear G 22 is transported to pulley P 22 via pulley P 21 which rotates together with gear G 22 and via timing belt TB 1 to drive the drive system of process cartridge moving means.

Concerning the drive system of process cartridge moving means, the rotational force that has been delivered to pulley 22 is delivered to gear G 29, which is engaged with gear G 28 that rotates together with pulley P 22, and to gear G 30 which is engaged with this gear G 29. Then that rotational force is delivered to gear G 31 via electromagnetic clutch C 22 according to necessity. Gear G 31 and gear G 32 are cross-axis gears that deliver the rotational force delivered to gear G 31 to pinion P. (Refer to FIG. 4). This pinion is capable of engaging with rack R which is installed on the side of process cartridge 15 and moves process cartridge 15 in left-right direction through rotation of pinion P and slide of rack 15. The movement of process cartridge 15 will be explained in detail in the latter part.

The next explanation will be on the drive system for waste toner collection.

The rotational force of motor M 2 that has been delivered to pulley P 22 is transported to pulley P 23 according to necessity via an open-type spring clutch C 22 A to drive the drive system of waste toner screw 261.

Concerning the drive system of waste toner screw 261, gear G 33, which rotates together with pulley P 23, is engaged with waste toner screw drive gear G 34 on the side of process cartridge 15 so that the rotational force delivered to pulley P 23 can drive the waste toner screw 261. The waste toner screw 261 transports the residual toner on photoreceptor belt 17 which has been removed by cleaning means 25 to toner collection box 26 via toner collection pipe 262 with a built-in rotating coil spring.

The next explanation will be on the drive system of toner hoppers 35*a*–35*d*.

The rotational force of motor M 2 that has been delivered to pulley P 23 is transported to pulley P 24 via timing belt TB 2 and then to gear G 35 when necessary via spring clutch C 24 and to gear G 36 which is engaged with this gear G 35. Then spring clutches C 25*a*–C 25*d* are connected when necessary to rotate gears G 38*a*–G 28*d* that are engaged with gears G 37*a*–G 37*d* which rotate together with gear G 36. And then the toner hopper stirring screws 351*a*–351*d* rotate together with gears G 38*a*–G 38*d* to stir the supply toners inside toner hoppers 35*a*–35*d*, while supply toner screws 352*a*–352*d*, which are installed on the same axis as gears G 39*a*–G 39*d* that are engaged with gears G 38*a*–G 38*d*, rotate to transport the supply toner to developing means 23*a*–23*d* inside the process cartridge 15. Incidentally, toner hoppers 35*a*–35*d* are driven in accordance with the drive of the aforementioned developing means 23*a*–23*d*. In other words, only the toner hopper that stores the supply toner of the same color is driven as long as the developing means which corresponds to the color which is forming an image is driven. Spring clutches C 25*a*–C 25*d* are used to control this drive, and control can be performed by using a step motor and a cam (both not shown in the diagram) as in the control of developing means drive.

Although the drive system for photoreceptor belt 17 as well as developing means 23*a*–23*d*, waste toner screw 261, toner hopper 35 and the drive system for process cartridge moving means are driven by using two motors M 1 and M 2, one motor can be used to drive them. Needless to say, a special motor can be installed for process cartridge moving means.

Figure 5:
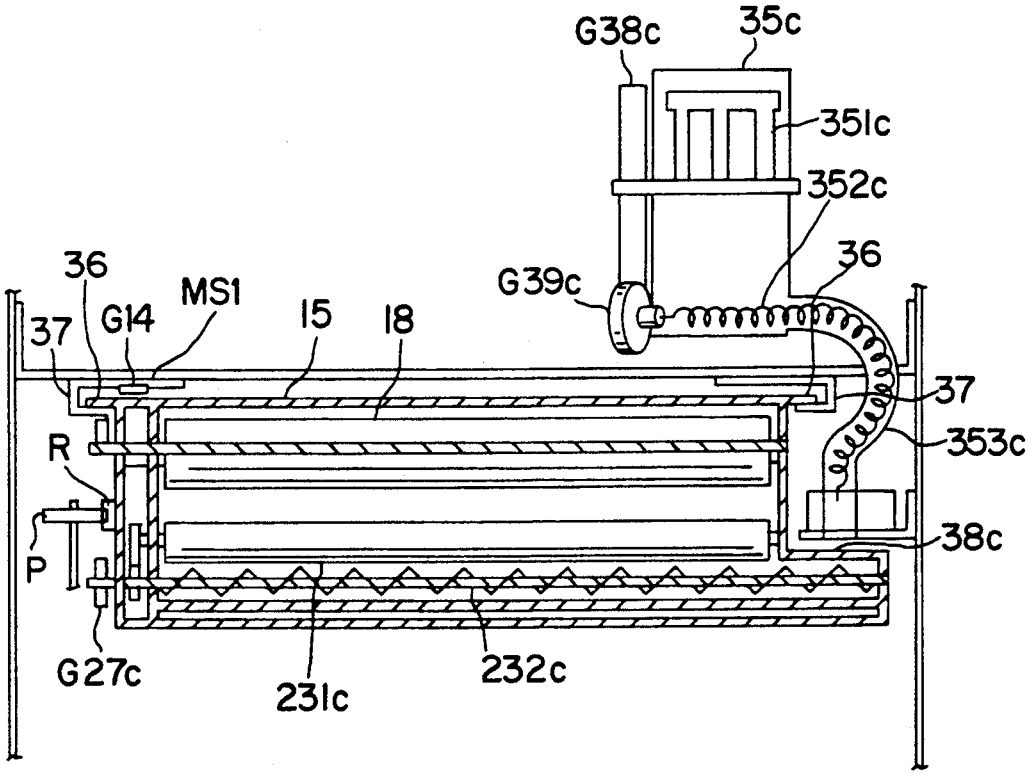
FIG. 5 is a diagram showing AA cross section in FIG. 1.

Next, the movement of process cartridge 15 will be explained by using FIG. 5, which is a AA cross section of FIG. 1, and FIG. 6, which shows the movement of process cartridge 15 in a typical manner.

Process cartridge 15 has a protruding member 36 and rack R for movement and on its side as well as drive gear G 14 for image formation are provided, developing means drive gears G 27*a*–G 27*d* and waste toner screw drive gear G 34.

Guide member 37, which supports process cartridge 15 by having protruding member 36 of process cartridge 15 inserted therein, drive gear G 14, gear G 13 which accommodates developing means drive gears G 27*a*–G 27*d* and waste toner screw drive gear G 34, gears G 26*a*–G 26*d* and gear G 33 are laid out inside the process cartridge storage of the apparatus body 10. In addition, pinion P is set up so that it can be engaged with rack R which is set up on process cartridge 15. Further, this guide member 37 has first and second microswitches MS 1 and MS 2. These first and second microswitches MS 1 and MS 2 are detection means for detecting the position of process cartridge 15. Here, first and second microswitches MS 1 and MS 2 detect the first position where drive gear G 14 installed on process cartridge 15, developing means drive gears G 27*a*–G 27*d*, waste toner screw drive gear G 34 are engaged with gear G 13, gears G 26*a*–G 26*d* and gear G 33 and image formation becomes possible, as well as the second position which is a position further separated from transfer means 24 compared to the first position, i.e. a position that has retreated from the first position in a direction which is opposite from the direction process cartridge 15 is inserted, and output their position signals to the control unit. However, the second position is decided in such a way that the center of gravity of process cartridge 15 does not fall outside the unit 10. The reason for this is that, if the center of gravity of process cartridge 15 is outside the unit, rack R and pinion P go out of mesh which makes extraction and insertion of process cartridge 15 difficult. The position detection sensors which detect the first and second positions are not limited to microswitches alone; various existing sensors such as a photoelectric switch and magnetic switch can be used. Moreover, the first and second microswitches MS 1 and MS 2 can be installed on the main unit body 10 as all that is required from them is to detect the first and second positions and they do not have to be installed on guide member 37.

Figure 6A:
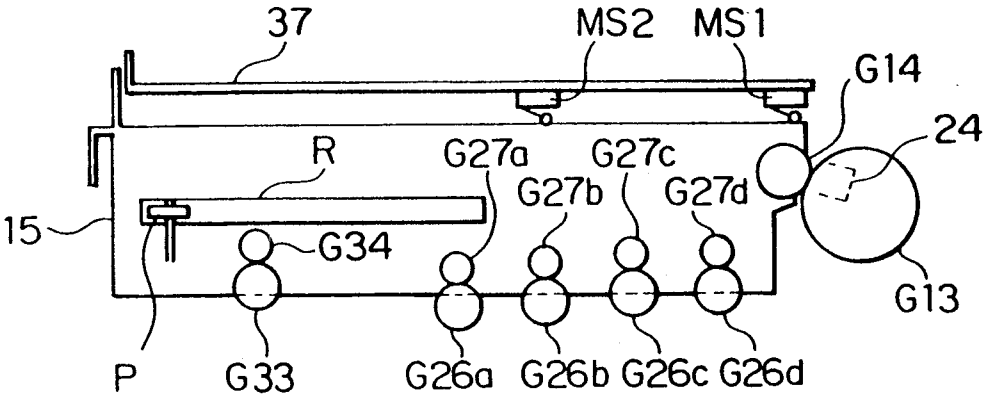
FIGS. 6*a–c* shows the movement of the process cartridge.
Figure 6B:
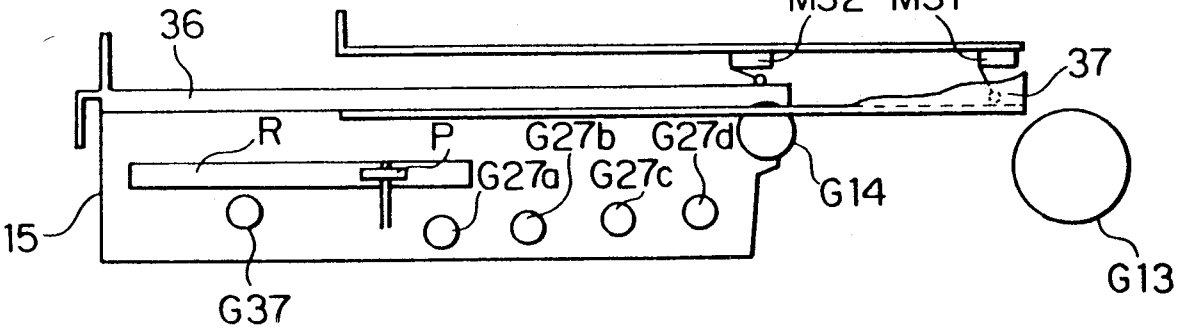
Figure 6C:
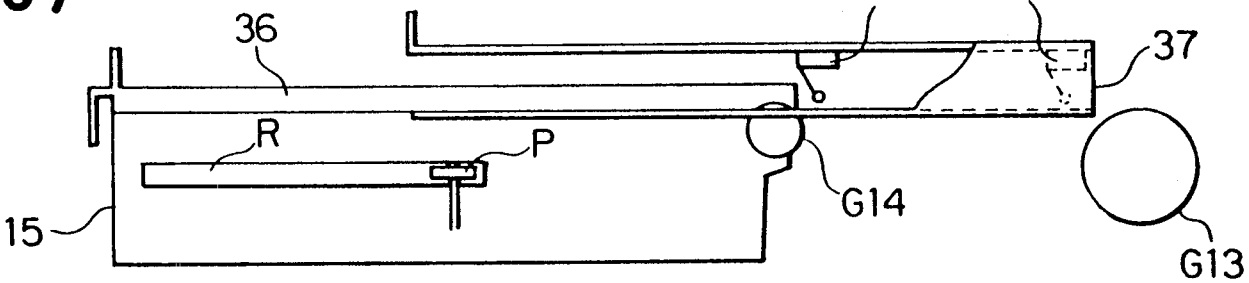

First, when ejecting process cartridge 15, process cartridge 15 is at the first position as shown in FIG. 6 (a), drive roller 18 and transfer pole 24 are keeping a desired distance (has adequate pressure when the transfer member is a transfer drum) and drive gear G14, developing means drive gears G 27*a*–G 27*d*, waste toner screw drive gear G 34, which are installed on process cartridge 15, are engaged with gear G 13, gears G 26*a*–G 26*d* and gear G 33 which are installed on the apparatus body 10 to drive them, which means that it is an optimum condition for image formation. Rack R and pinion P are also engaged.

Extraction signal is input to the control unit by opening the front cover 14 and pressing the extraction button in the operation panel 11 at the front of the apparatus body 10. If a print signal from the print button of the operation panel 11 as well as image forming process signals, which indicate that image forming process is working at photoreceptor belt drive unit, fixing unit, exit unit and feed unit (e.g. photoreceptor belt drive signal, fixing drive signal, exit drive signal and feed drive signal) are not emitted at this time, the control unit will send a signal to the motor M 2 and electromagnetic clutch C 22 which are the drive unit of the process cartridge moving means, rotates pinion P to move process cartridge 15 from the first position to the second position and moves process cartridge 15 along guide member 37 to the direction of the second position. (See FIG. 6(*b*).)

Then, when process cartridge 15 moves as shown in FIG. 6(*c*), it detects the movement of process cartridge 15 up to the second position by the second microswitch MS 2 turning off and sends that signal to the control unit. Receiving this signal, the control unit releases the electromagnetic clutch C 22 and stops the rotation of motor M 2.

In other words, process cartridge 15 stops at the second position when rack R and pinion P are engaged and retreats from the first position to the second position. Therefore, ample work space for jam procedure can be secured and easy removal of process cartridge 15 from the apparatus body 10 becomes possible by pulling it out slightly.

When inserting process cartridge 15 into the apparatus body 10, insert protruding member 36 of process cartridge 15 along guide member 37 inside the process cartridge engage rack R and pinion P, and insert process cartridge 15 so that it will come to the second position shown in FIG. 6(*c*) and pass that position slightly to turn on the aforementioned second microswitch MS 2.

To move the process cartridge 15 from this condition to the first position where image formation is possible, a set signal is input to the control unit by either inserting process cartridge 15 at the second position still further or pressing the set button on operation panel 11. When this set signal is input, the control unit sends a signal to the motor M 2 and electromagnetic clutch C 22, rotates pinion P to move process cartridge 15 from the second position to the first position (in reverse direction from that of rotation for ejection) and moves process cartridge 15 to the direction of the first position along the guide member 37 (FIG. 6(*b*)).

In addition, as shown in FIG. 6(*a*), the first microswitch MS 1 detects the movement of process cartridge 15 up to the first position and sends this signal to the control unit. Upon receiving this signal, the control unit releases the electromagnetic clutch C 22 and at the same time stops the rotation of motor M 2. That is, process cartridge 15 will stop at the first position, and drive gear G 14 installed on process cartridge 15, developing means drive gears G 27*a*–G 27*d*, waste toner screw drive gear G 34 is engaged with gear G 13, gears G 26*a*–G 26*d* and gear G 33 to make image formation possible. At this time, the toner transport pipes 353*a*–353*d* of toner hoppers 35*a*–35*d* are automatically connected to corresponding developing means 23*a*–23*d* inside process cartridge 15 and replenishes the toner. Accordingly, not only does it reduce the trouble of the operator significantly by automatically inserting process cartridge 15 through simple operation after exchanging process cartridge 15 or a jam procedure, but process cartridge 15 is set at a secure image forming position.

Meanwhile, the upper cover release means will be explained using FIG. 7. The upper cover 12 is supported by the upper cover axis 39. In addition, a spring has been attached to the upper cover 12 so that it will be released by a coil spring 40 which is coiled around the upper cover 12 and by pins 41 whose one end is attached on the apparatus body 10 and the other end on the upper cover, i.e. in counterclockwise direction in this diagram. Furthermore, solenoid 42 is placed so that it can latch the upper cover when it is closed.

Figure 7A:
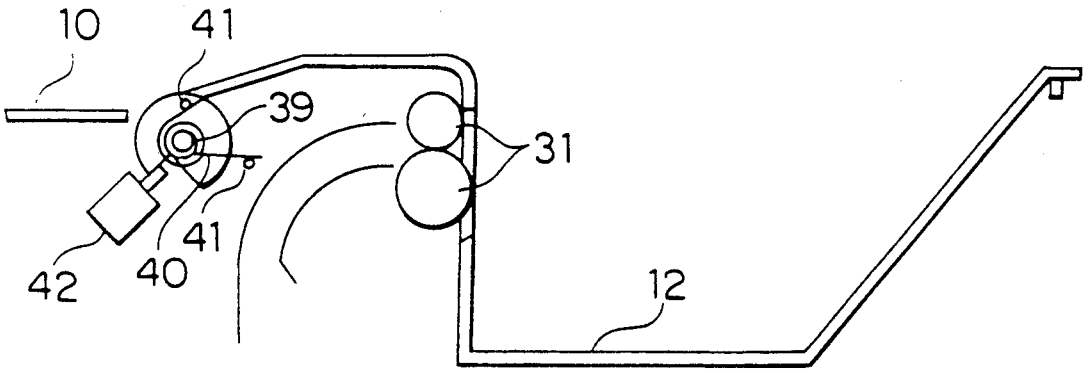
FIGS. 7(*a*) and (*b*) are side views showing an upper cover release.
Figure 7B:
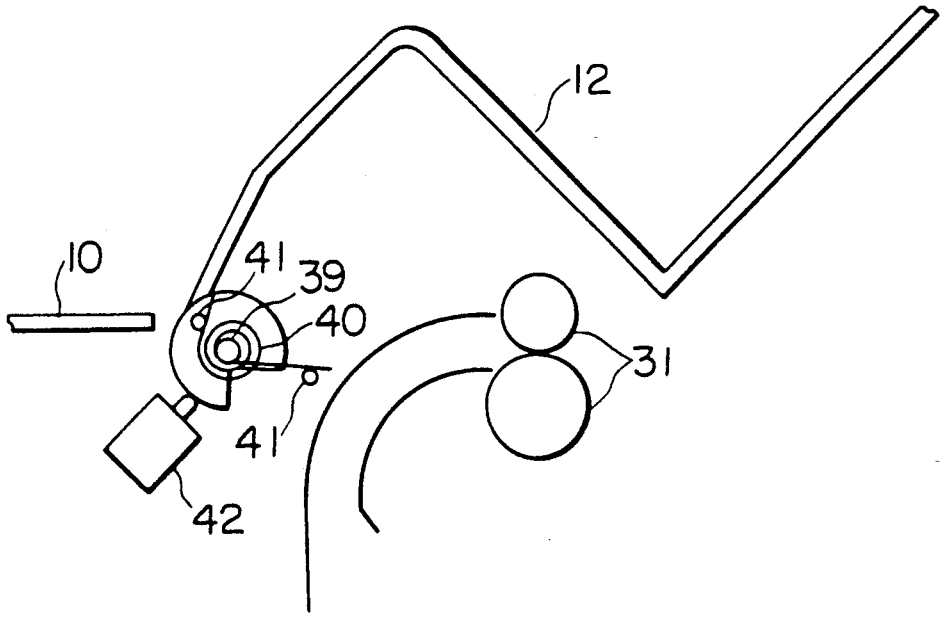

Through an upper cover release means which has the above structure, the upper cover 12 is closed during the image forming process, and the upper cover 12 also serves as discharge tray for transferred transfer materials that are discharged by discharge roller 31 (FIG. 7(*a*)). Then the ejection button of operation panel 11 which is installed on the front side of the apparatus body 10 is pressed at the time of jam procedure. And if an image forming process signal is not output, the control unit will emit a transfer signal to process cartridge moving means to move process cartridge 15 as mentioned earlier as well as a release signal to solenoid 42 which is an upper cover release means. After receiving a release signal, solenoid 42 retreats, i.e. put its latch on the upper cover 12, thereby releasing the upper cover 12. Then the upper cover 12 which had been attached by springs is released by its attaching force (FIG. 7(*b*)). The transfer material that caused the jam can be identified and removed easily from this release opening on the released upper cover 12. Incidentally, upper cover release means is not limited to this embodiment, and a member that can be latched can be placed on the other side of upper cover axis 39. In addition, a gear and a motor which is engaged with this gear can be placed on the upper cover axis 39 so that this motor will rotate at the output of release signal from the control unit and release the upper cover 12. In this case, it is also possible to input a set signal at the control unit to rotate this motor in a reverse direction and close the upper cover 12.

Figure 8:
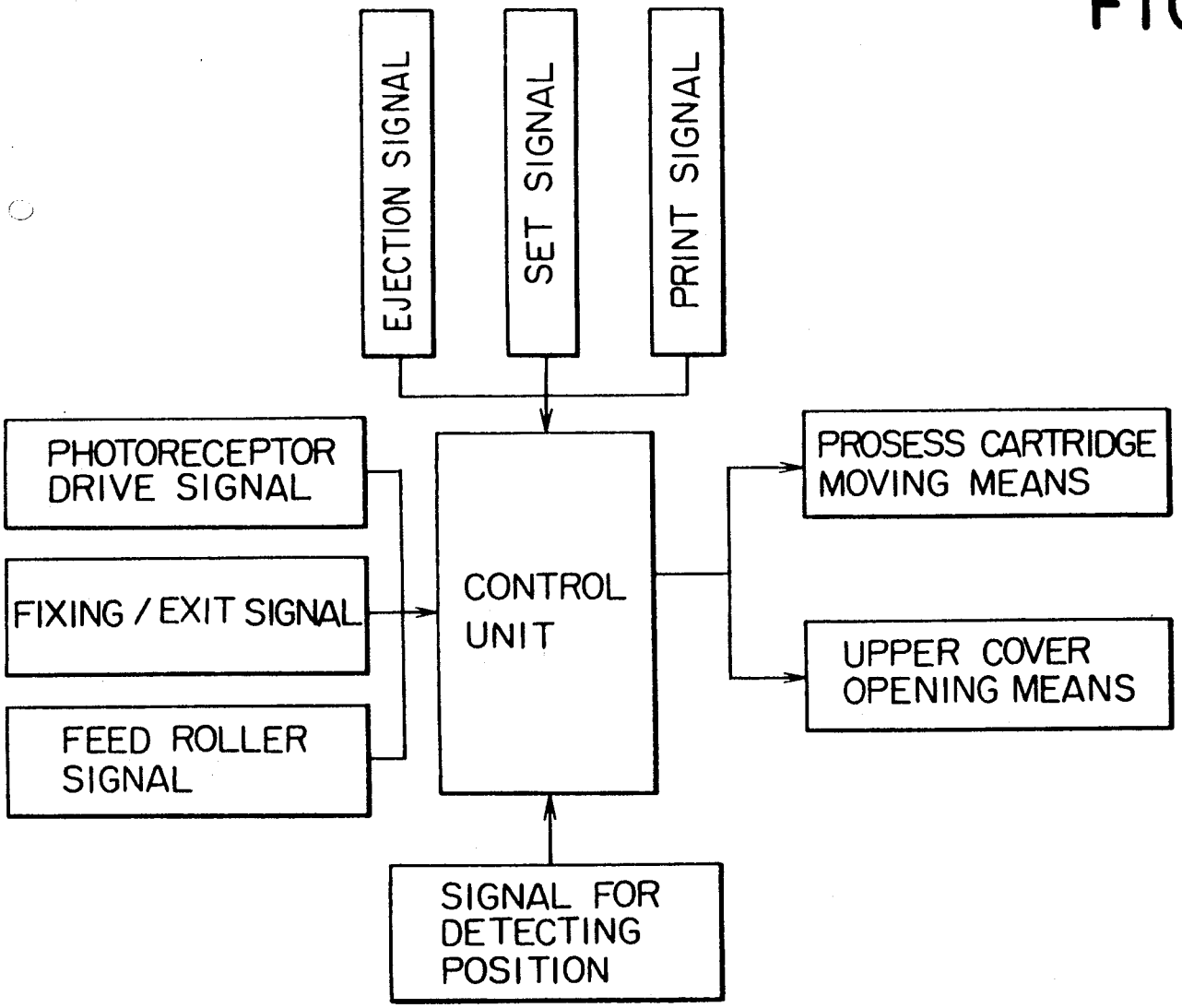
FIG. 8 is a diagram showing the control system.
Figure 9:
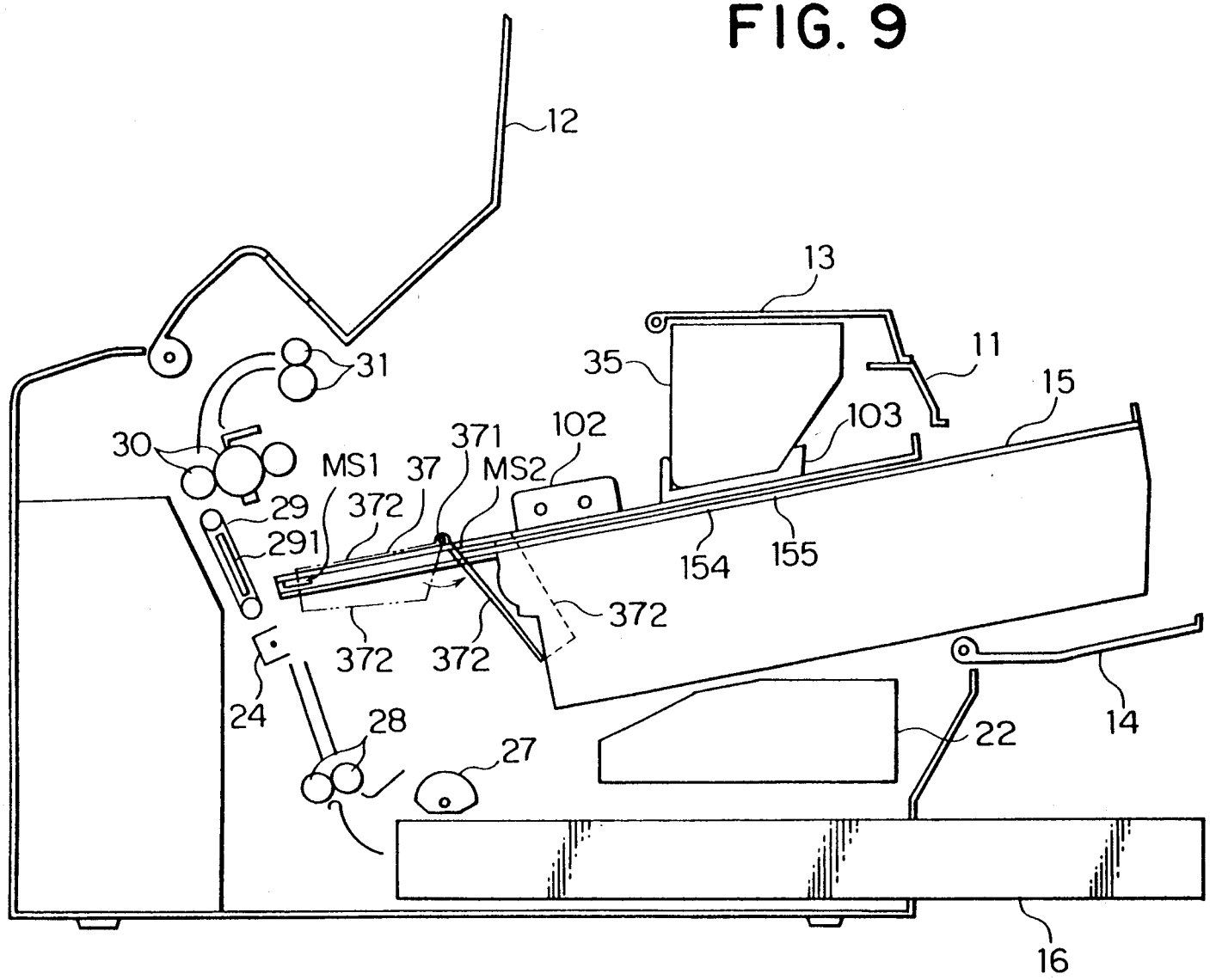
FIG. 9 is a diagram showing the color printer when the process cartridge is located in the second position from the left side.

The movement control and opening control of upper cover 12 by process cartridge 15 that have been explained up to this point will be as shown in FIG. 8. An ejection signal is input into the control unit when the ejection button on the operation panel is pressed. If print signal from the print button of the operation unit as well as a photoreceptor belt signal, fixing/exit signal and feed drive signal from the photoreceptor belt drive unit, fixing/exit unit and feed unit, respectively, are not output to indicate that these units are operating, then the control unit will emit a movement signal to the process cartridge moving means. The process cartridge moving means unit will control the process cartridge movement drive system to move process cartridge 15 from the first position to the second position, and stop the process cartridge movement drive system once it receives the position detection signal which detects the movement of process cartridge 15 to the second position. Meanwhile, the control unit will emit a movement signal while emitting an open signal to the upper cover opening means to open the upper cover 12. In other words, the exchange of process cartridge 15 is simplified, the jammed transfer material can be easily confirmed and removed from the upper portion of the apparatus body 10 and the process cartridge 15 at the second position can be ejected by pulling it out slightly because process cartridge 15 retreats to the second position and upper cover 12 opens at the same time as shown in FIG. 9 by simply pressing the ejection button at the operation panel 11 when a jam occurs or when exchanging process cartridge 15. Moreover, even if an ejection button is pressed while the image forming process is in operation, the signal will be canceled at the control unit so that process cartridge 15 will not move and upper cover 12 will remain closed.

In this embodiment, an image forming method in which a color toner image is formed on the photoreceptor belt and transferred on the transfer material in one procedure has been described as the image forming process. However, this can be a color image forming method which transfers a toner image by registrating them on transfer paper on a transfer drum. It can also be applied to an ordinary monochrome printer that uses a monochrome process. In addition, although the description focused on the non-contact developing method, this invention is not limited to this non-contact developing method and can be applied to the contact developing method as well. Furthermore, the drive system shown in this embodiment is merely an example, and it goes without saying that it is not limited to the combinations of these gears, clutches and belts.

Figure 10:
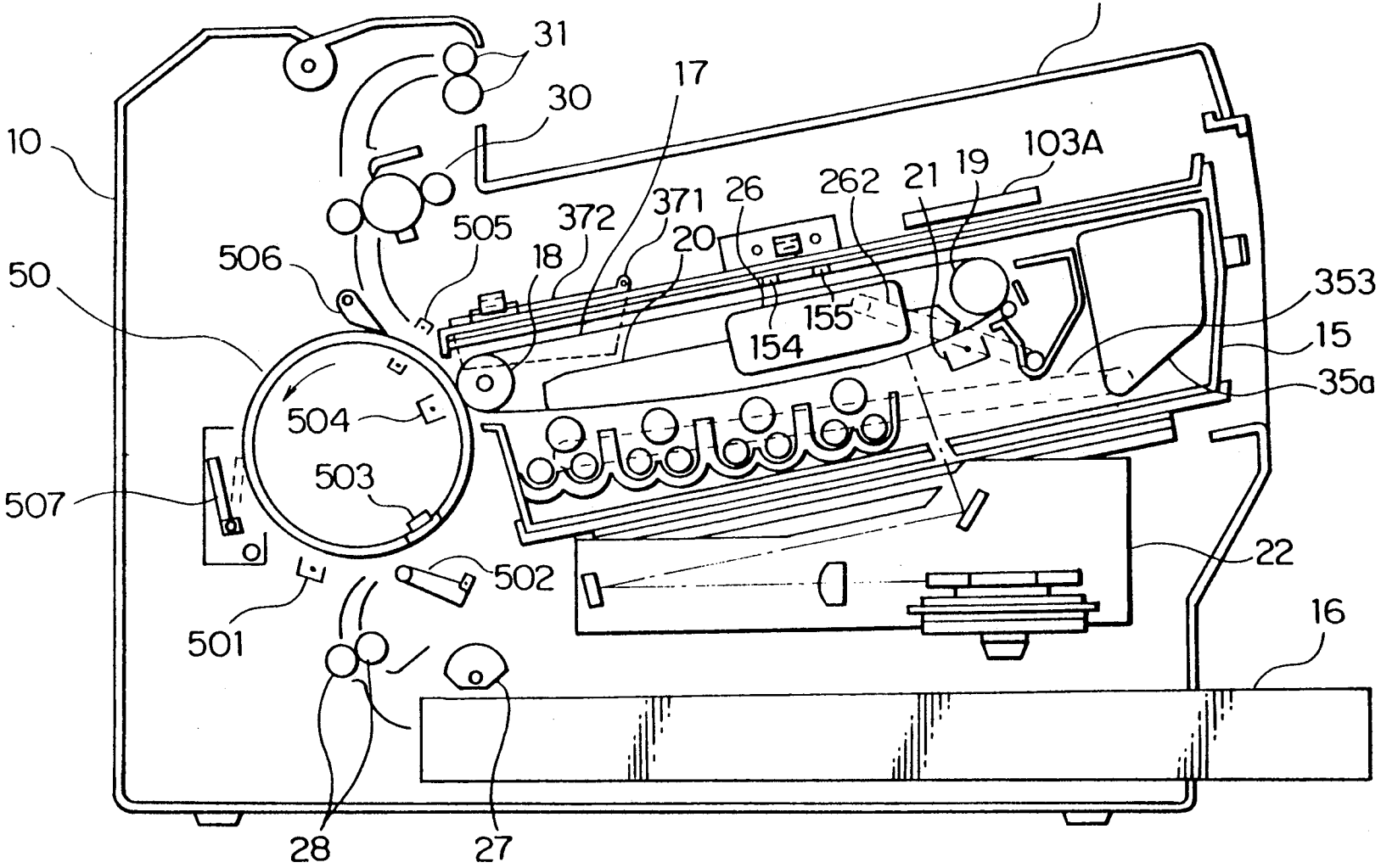
FIG. 10 is a diagram of a main cross section of a transfer drum type image forming apparatus to which the invention is applied.

FIG. 10 shows the transfer drum type image forming apparatus as another embodiment to which this invention has been applied. While the process cartridge 15 is otherwise identical to the previous embodiment, toner hopper 35*a* is included in the process cartridge 15. A transfer drum type image forming apparatus has a transfer drum 50 contacting the transfer unit of photoreceptor belt 17, and this transfer drum rotates counterclockwise keeping synchronization with photoreceptor belt 17. A toner image for each color formed on photoreceptor belt 27 is transferred on the transfer material when this transfer material is wound around the circumference of transfer drum 50. Then it is separated from the transfer drum 50 after superimposing the toner images of respective colors on the transfer material and discharged on the upper section of the apparatus body after it had settled.

Installed around the circumference of transfer drum 50 are charger 501 for static electricity adsorption of transfer material and winding member 502 for mechanically winding transfer material on transfer drum 50. Since winding member 502 has a roller at its tip, it comes in contact only when transfer material is wound around transfer drum 50. In addition, gripper 503 is placed on the circumferential surface of transfer drum 50 to hold the leading edge of transfer material that has been transported in synchronization. Transfer means 504 performs the transfer of the toner image from photoreceptor belt 17 onto the transfer material. Separator/discharger 505 and the separation claw separate transfer material from transfer drum 50 after transfer is made. Further, attachable and removable cleaner 507 removes toner that remains attached on the transfer drum 50 after the transfer material is separated.

The transfer material supplied by cassette 16 moves on to transfer drum 50 which has been electrically charged by charger 501 while maintaining synchronization, is wound around it with winding member 502, its leading edge is held by gripper 503 and the yellow toner image that has been formed on photoreceptor belt 17 is transferred by transfer means 504 of the transfer unit. After completing the first transfer, the transfer drum 50 continues to rotate and transfers the next toner image is transferred after being cleaned by the cleaner 507. In other words, it transfers the magenta toner image on the second rotation, the cyan toner image on the third rotation and the black toner image on the fourth rotation by superimposing them one after another. When the transfer of toner images of the four colors is completed, the transfer material is removed at separator 505, and is transported to fixing roller 30 after the leading edge of transfer material is released and is separated by separation claw 506.

In the image forming apparatus of this embodiment, transfer drum 50 is located on the side of the main unit body 10 and is not included in the portable process cartridge 15. Therefore, process cartridge 15 is moved in the same manner as the previous embodiment.

If process cartridge 15 is moved from the first loading position to the second loading position, the upper cover 12 is opened and the area around transfer means 24, transport channel 29 and fixing means 30 are opened with ample space to make trouble management easy. However, as light fatigue will occur at the exposed section of the photoreceptor belt if it is left as it is, a photoreceptor cover 372, which rotates around support axis 371 which is fixed on the main body, is installed at the tip along guide member 37 of process cartridge 15 on the apparatus body 10, and this cover is attached with a torque spring so that it will rotate in a counterclockwise direction at all times. If process cartridge 15 is at the first loading position, it is pushed up by the outer upper surface of this cartridge, and the photoreceptor belt is open facing transfer means 24 or transfer drum 50 as shown in FIG. 1 and FIG. 10.

However, the exposed portion of the photoreceptor at the tip of process cartridge 15 is surrounded and made light tight by this photoreceptor cover 372 when this cartridge retreats to the second loading position as shown in FIG. 9.

Meanwhile, windows 154 and 155 are provided at the position corresponding to process cartridge 15 at the first loading position against working member block 102 which is equipped with electricity removal apparatus, comprised of an electricity removal lamp or an electricity removal pole, or a light exposure apparatus.

However, if process cartridge 15 retreats to the second position and upper cover 12 is opened, external light will enter from the above windows 154 and 155 and result in light fatigue of the photoreceptor. To prevent this, the light tightness is maintained by positioning process cartridge 15 behind a stand 103 for toner hopper 35 which is installed on the main body along guide member 37 or a special shield 103A shown in FIG. 10 when it retreats to the second loading position.

In addition, the same effect can be obtained by installing work member 102 on the aforementioned photoreceptor cover 372 instead of on the apparatus body 10.

Figure 11:
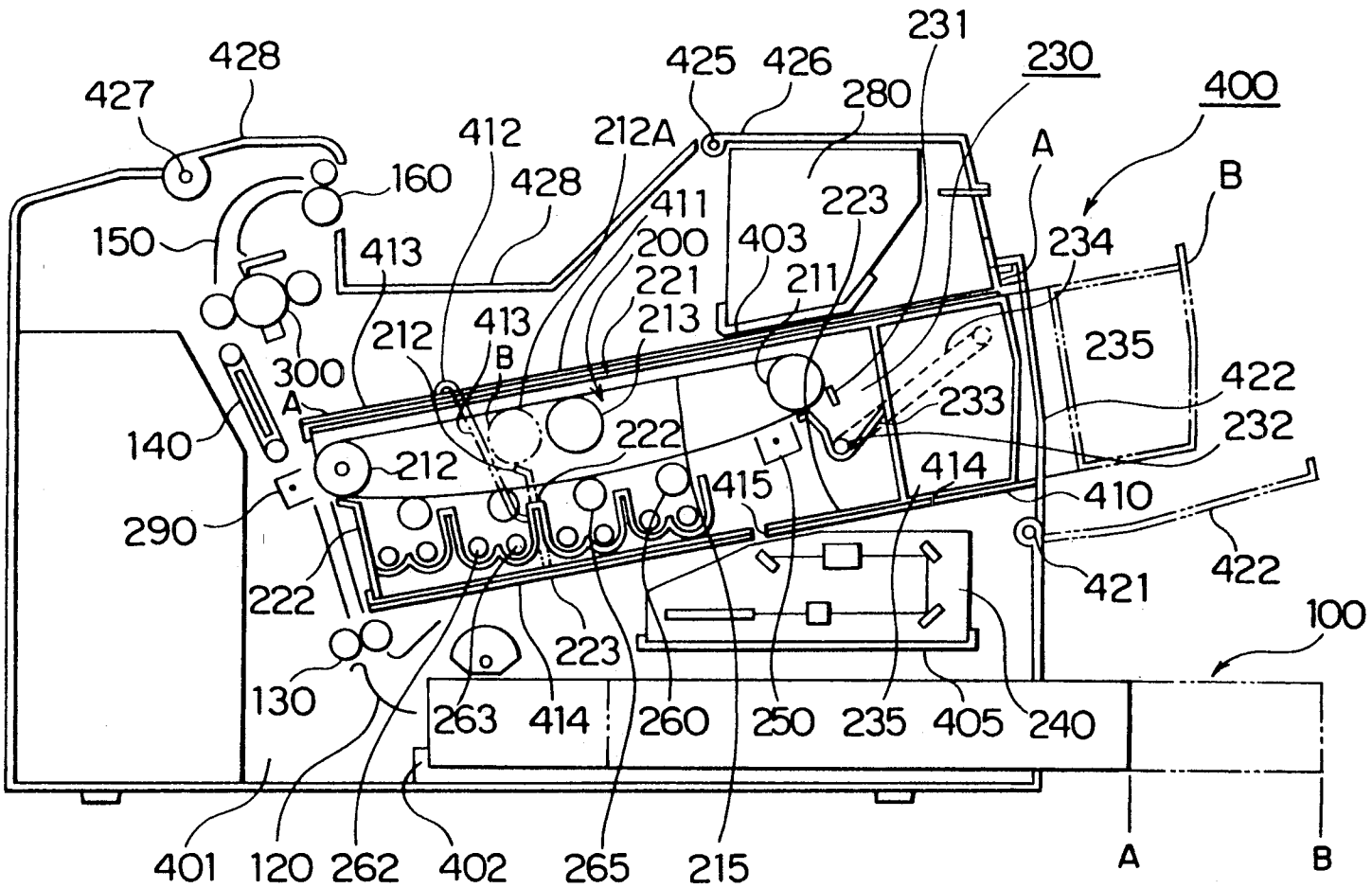
FIG. 11 is a side view of another embodiment of the invention.

Yet another embodiment of image forming apparatus in this invention is explained by using a side cross section in FIG. 11.

Installed on the frame 401 of the main body 400 are storage unit 402 of document paper supply cassette 100, transport guide for document paper 120, a pair of transport rollers 130, transfer pole 290, suction belt for transport 140, thermal fixer 300, exit transport guide 150 and a pair of exit transport rollers. Also installed are photoreceptor belt 215 on belt rollers 211, 212, 213, process cartridge 200 that contains electric charging pole 250, developing means 260, cleaner 230 and waste toner collection case 235, storage unit 410 which is equipped with guide member 411 and 413 with a structure to slide this cartridge 200 in a removable manner, stand frame 405 which stores the optical system for writing and storage stand 403 for toner supplier 280.

A light exposure window 415 from this optical system 240 to photoreceptor belt 215 and a light entry opening on the lower wall 223 on outer structure 221 of process cartridge 400 are also provided.

Developing means 260 has 4 units of developing means for each color Y, M, C and black when used in full color, with each developing means 260 comprised of a toner transport, stirring screws 262, 263 and development sleeve 265. Further, charger 250, toner collection unit 230 and waste toner collection case 235 are installed, while the residue toner that has been scraped off by cleaning blade 231 is received by container 232 and then transported by screw 234 and sent to waste toner collection case 235.

Further, each of these functions is disposed in the outer structure 221 of process cartridge.

In addition, each developing means 260 has a corresponding toner replenisher 280 on the upper part of the process cartridge, and a pipe with a built-in flexible transport screw is connected in a removable manner from this replenisher 280 to each developing means 260.

Moreover, a protection cover 413, which is a rotating movable board, is set up around support axis 412 at the tip of guide member 411 on the upper part of storage unit 410 of the aforementioned process cartridge 200 and is attached to rotate counterclockwise.

This protection cover 413 is rotated in a counterclockwise direction when the process cartridge is pulled out diagonally in an upper right hand direction and retreats from position A to position B. Its position will be as shown by a dotted line, and the internal part of process cartridge, particularly the part around the photoreceptor, will be tightly sealed.

Movable exterior covers are located at three positions as opening/closing covers on the outer surface of the main body 400. One of them is an upper cover which rotates around support axis 427; opening this and moving the aforementioned process cartridge to the right will expose the surroundings of the transport path for transfer paper to facilitate trouble management such as jamming of paper. The next one is the cover 426 that rotates around support axis 425. Opening this cover will make maintenance and inspection of toner replenisher 280 easy and enable toner replenishment. The last one is cover 422 which rotates around support axis 421. Opening this cover will move the process cartridge at position A where loading position is completed to an external retreat position B and allows it to be pulled out of storage unit 410 from that position, thereby making it possible to repair and exchange photoreceptor belt and other parts of the process cartridge.

The next explanation concerns stably image forming functions. The photoreceptor belt 215 which has been cleaned by cleaning blade 231 is given an electric charge on its surface by electrically charged pole 250 while being rotated in a clockwise direction, the memory image Y is exposed by write-in optical system 240, the memory image M is exposed by write-in optical system 240 while Y is being developed. Photoreceptor belt 215 rotates again, M is developed machine, and C toner and black toner are put on the prescribed position of the photoreceptor in a similar manner as development progresses.

And lastly, transfer pole 290 functions and synchronizes with document paper which is supplied one by one at proper timing from document paper cartridge 100 and passes through transport guide 120, transport roller 130 transport guide 122 to transfer the toner image of the aforementioned 4 colors.

The transfer paper that receives this transfer image is accumulated and collected on the aforementioned upper cover 428, which serves as a movable outer cover, by a pair of exit transport rollers after being put through fixing means 300 and exit transport guide 150 by the transport suction belt.

Cleaning blade 231 is designed in such a way that it is kept away from the surface of photoreceptor belt 214 until the four light exposures and development are completed. Application of high voltage is also stopped at transfer pole 290.

Figure 12:
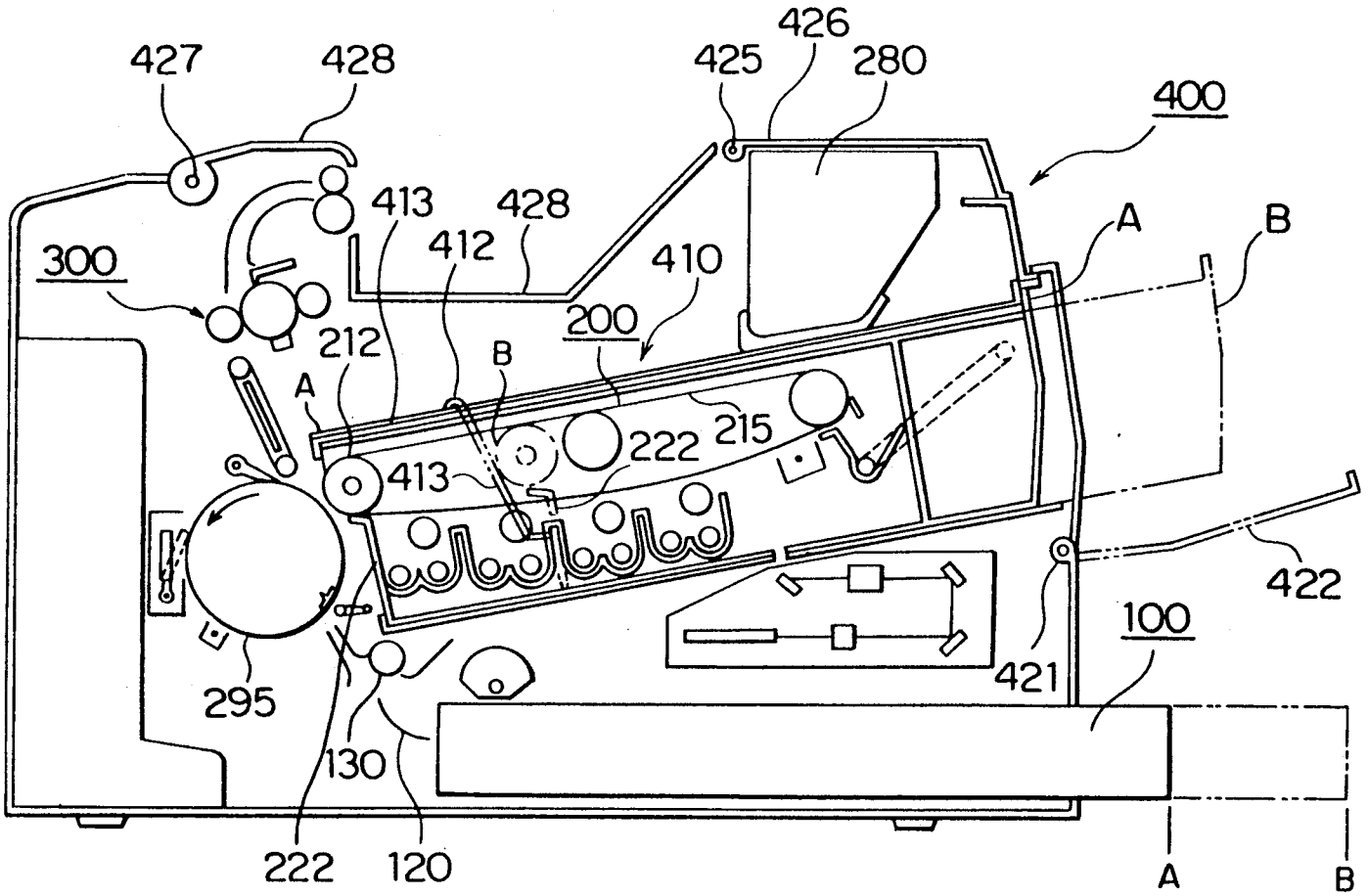
FIG. 12 is a side view of still another embodiment of the invention.
Figure 13:
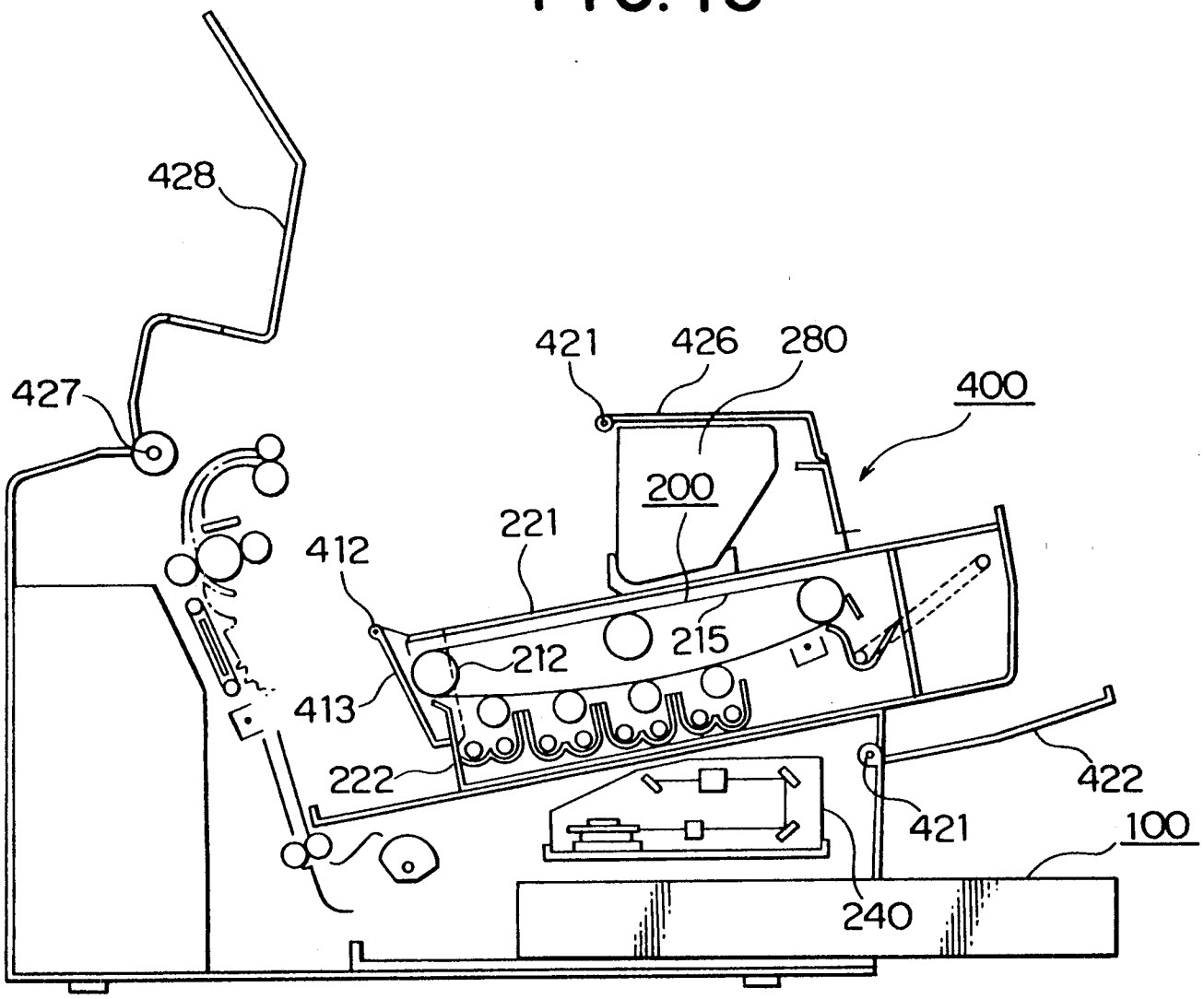
FIG. 13 is a side view of an opened condition during transportation of sheets.

As shown in FIG. 12, transfer drum 295 can be installed instead of a transfer pole for synchronized transfer registration on transfer paper which is wound around transfer drum 295 for development of each color such as Y, M, C and black. In this case, the operation of the cleaning blade for each color is not necessary. The following is a brief description regarding the drive system.

The photoreceptor belt, which is driven almost all the time, is driven separately by an independent motor, while developing means drive, toner replenishment related drive, waste toner screw drive, process cartridge moving drive and feed cassette moving drive are all driven by one motor. However, a system with one motor driving everything is also acceptable. Control of toner replenishment according to toner consumption by the developing means is performed by the combination of spring clutch, ratchet wheel and claw. Although process cartridge 200 and feed cassette are moved by switching development drive switching cam, spring clutch and solenoid by using a signal from the control apparatus by a detection signal, these are not the only means of movement.

When a transport trouble of the transfer paper, i.e. jam, occurs near the transfer unit, the process cartridge is moved from the loading completion position A, i.e. steady position, to the retreating position B, followed by rotational movement of movable board 413, which serves as a movable protection cover, around support axis 412 to the position shown by a two-dot chain line. Then it comes in contact with external wall 222 at the tip of external structure 221 of process cartridge 200, wraps around the outer portion of this cartridge and shields the photoreceptor belt 215 to make it light tight. Furthermore, as the upper cover 428 which serves as a movable outer cover is opened, transfer paper transport path and the area around transfer pole 290 and fixing machine 300 are opened widely to facilitate jam management. Further, movable board 413 which serves as movable protection cover is attached to a spring to rotate in a counterclockwise direction at all times, moving with the retreat movement of process cartridge 200 to shield the photoreceptor and moving forward so that in a steady image forming condition, i.e. the process of reaching the aforementioned position A, this movable board is pushed up by the tip of the cartridge to expose the photoreceptor belt and place it in proximity to the transfer unit. On the other hand, the aforementioned upper cover 428 which serves as a movable outer cover shields the main body 400 by another signal.

Figure 14A:
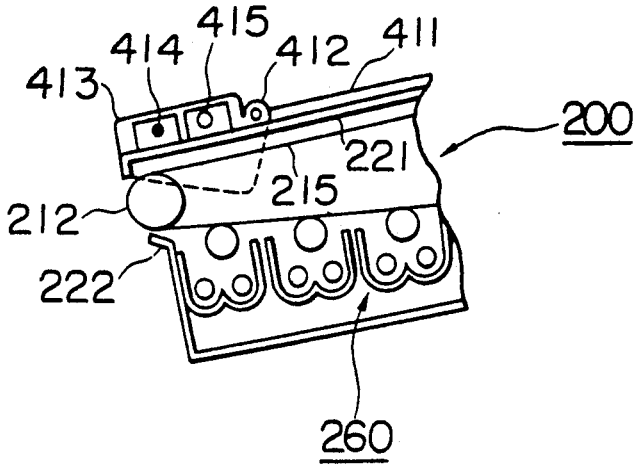
FIG. 14(*a*) and (*b*) are side views showing the condition of a movable protective cover in other embodiments of the invention.
Figure 14B:
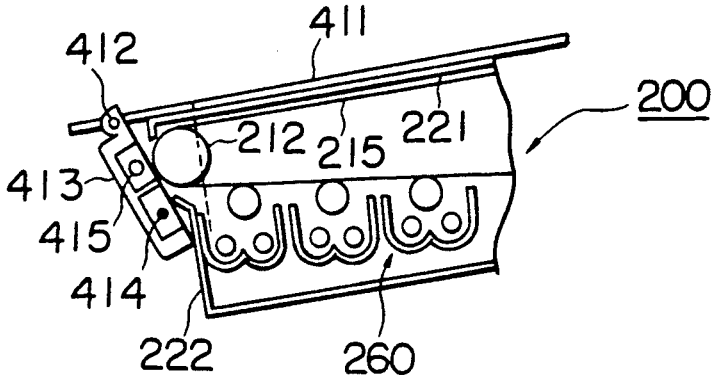

In still another embodiment, a discharger or a discharging lamp can be installed in the inner back side of the movable board. FIG. 14(*a*) and (*b*) show the side view of movable board 413 with electricity remover 414 and electricity removing lamp 415 installed. FIG. 14(*a*) shows the condition of process cartridge 200 installation and FIG. 14(*b*) shows the condition of process cartridge 200 retreat. Furthermore, the installation of the light path for the exposure apparatus and electricity charger will not create any problem, and it can also contribute to a compact layout by being installed at the time of installing various other members, in addition to the light tight shielding effect.

Although a color image forming apparatus equipped with four developing means has been explained in this embodiment, this apparatus can be used with any method such as monochrome, single color or a combination of two or three colors. In addition, the object of this invention can be achieved even if the developing means is a single image forming apparatus that can provide a single color picture.

Incidentally, the feed cassette 100 in this embodiment can retreat as shown by a chain line in FIG. 11 and FIG. 12 because there are cases where it is easier to clear jammed sheets by retreating it with process cartridge 200 when a transport trouble of the sheets occurs. In addition, although retreating of process cartridge 200 and feed cassette 100 from position A to position B and forwarding them from position B to position A are done automatically by power in this invention, ejecting this cartridge and cassette from position B and setting them at position B is done manually. Thanks to this arrangement, loading and unloading of respective cartridges and cassettes is easy and the problem of damaging the apparatus as a result has been eliminated. The effect is particularly felt when removing the process cartridge 200 from the main body to exchange members such as the photoreceptor belt and when performing maintenance work. Moreover, although a photoreceptor belt was used in this embodiment, a photoreceptor drum can also be used as an image carrying body.

As explained in detail above, this invention offers an image forming apparatus in which the process cartridge retreats from the position where an image can be formed while protecting the photoreceptor after opening the upper cover by pressing the button at the operation unit, light fatigue is not created on the photoreceptor, high quality image forming performance is maintained and a process cartridge is installed at the optimum position at the time of insertion.

As a result, as the process cartridge moves and the upper cover opens automatically by simple operation in the image forming apparatus of this invention, an operator can exchange the process cartridge without confusion and large force. Moreover, an ample work space can be secured as the process cartridge can be retreated to the second position for visual contact inside the main body of the apparatus from the opening in the upper cover to significantly improve the nature of jam management work, while eliminating the risk of damaging the image carrier at the time of taking out the jammed material, and the chances of an operator's hand coming in direct contact with the image carrier at the same time. Furthermore, unnecessary vibration is not given to the process cartridge because it is moved mechanically, giving rise to an effect of improved maintenance by making it possible to exchange the process cartridge, creating hardly any scattering of developer. Further, usability and maintenance equivalent to unidirectional operability of a monochrome printer have been realized by the structure in which loading and unloading of the process cartridge and toner replenishment can all be done from the front side when a color printer is used for this image forming apparatus.

Even if a transport trouble of transfer paper occurs, the image forming apparatus of this invention will detect it automatically while the process cartridge, and also the feed cassette in some cases, retreats to a certain position and the outer cover creates a large space around the place where the trouble has occurred, making it possible to easily, safely and speedily remove the transfer paper that caused the transport trouble of transfer sheets.

Furthermore, the movable protection cover at the upper side of the process cartridge storage frame comes down at the time of process cartridge retreat movement to cover the window on the outer part of the tip of the process cartridge and automatically shield the photoreceptor from that window, thereby enabling complete elimination of phenomena that reduce the life of a photoreceptor or lower its performance through light fatigue.

What is claimed is:

1. An image forming apparatus comprising:

(a) a process cartridge having an opening in which an image carrying member is provided, said process cartridge being capable of being moved to and from a working member with respect to image forming;

(b) said working member being provided in a main body of said apparatus for exerting an action on said image carrying member;

(c) an opening and closing member whereby a sheet transport path is accessible when open;

(d) a shielding member provided on the main body of said apparatus; and (e) said opening being provided to face said working member, said opening being covered by said shielding member when said process cartridge is moved from said apparatus in accordance with an opening movement of said opening and closing member.

2. An image forming apparatus comprising;

(a) a process cartridge including an image carrying member on which an image can be formed at a position where said process cartridge is fully but detachably mounted on a main body of said apparatus;

(b) a member for guiding the detaching and mounting movement of said process cartridge; and (c) a working member for image formation for exerting an action on a first zone of said image carrying member when said process cartridge is located at said position, said working member being in said main body, and comprising at least one of a discharging element, a charging element, and an exposure element; wherein said working member faces a second zone different from said first zone when said process cartridge is moved along said guide member away from said position.

3. An image forming apparatus comprising:

(a) a process cartridge including an image carrying member on which an image is formed, said process cartridge being detachably mountable on said apparatus in a direction perpendicular to the rotation axis of said image carrying member;

(b) a member for guiding the detaching and mounting movement of said process cartridge; and (c) a movable protective cover for protecting said image carrying member;

wherein said process cartridge is directly moved from a position where image formation is possible, and when said process cartridge is moved away from its mounting on said apparatus along said guide member; said protective cover is closed so that protection of said image carrying member and formation of large space around a transfer sheet conveyance path can be achieved.

4. The apparatus of claim 3, wherein said protective cover shields said image carrying member from the light when said protective cover is closed.

5. The apparatus of claim 3, wherein the opening and closing movement of said protective cover is achieved by a pivoting action in accordance with the detaching and mounting movement of said process cartridge.

6. An image forming apparatus comprising:

(a) a process cartridge including an image carrying member on which an image is formed, said process cartridge being detachably mountable on said apparatus;

(b) a member for guiding the detaching and mounting movement of said process cartridge; and (c) a moveable protective cover for protecting said image carrying member;

wherein the opening and closing movement of said protective cover is achieved by a pivoting action in accordance with the detaching and mounting movements of said process cartridge, said pivoting action being activated when said process cartridge is moved away from its mounting on said apparatus along said guide member; said protective cover is closed so that protection of said image carrying member and formation of a large space around a transfer sheet conveyance path can be achieved, and said protective cover further includes a working member with respect to image forming for exerting an action on said image carrying member, which said working member is at least one of a discharging element, a charging element, and an exposure element.

* * * * *